US009527620B2

(12) United States Patent
Dart et al.

(10) Patent No.: US 9,527,620 B2
(45) Date of Patent: Dec. 27, 2016

(54) PAPER WRAPPED FOAM CUP AND METHOD OF ASSEMBLY

(75) Inventors: Robert C. Dart, Georgetown (KY); Roger E. Payne, Okemos, MI (US); Steven C. Hills, Dansville, MI (US); Steven K. Makela, Leslie, MI (US); Brent M. Smith, DeWitt, MI (US)

(73) Assignee: Dart Container Corporation, Mason, MI (US)

( * ) Notice: Subject to any disclaimer, the term of this patent is extended or adjusted under 35 U.S.C. 154(b) by 2034 days.

(21) Appl. No.: 10/907,597

(22) Filed: Apr. 7, 2005

(65) Prior Publication Data

US 2005/0227029 A1 Oct. 13, 2005

Related U.S. Application Data

(60) Provisional application No. 60/521,359, filed on Apr. 8, 2004.

(51) Int. Cl.

| | |
|---|---|
| ***B65D 21/02*** | (2006.01) |
| ***B65D 1/26*** | (2006.01) |
| ***B65D 25/36*** | (2006.01) |
| ***B65D 81/38*** | (2006.01) |

(52) U.S. Cl.

CPC ..... *B65D 1/265* (2013.01); *B65D 25/36* (2013.01); *B65D 81/3874* (2013.01); *Y10T 428/1376* (2015.01)

(58) Field of Classification Search

USPC ... 428/34.5, 34.2, 220, 292.1; 156/215, 556, 156/567, 239, 249; 206/520, 519, 217; 220/717, 220/839, 673; 229/400; 264/259

See application file for complete search history.

(56) References Cited

U.S. PATENT DOCUMENTS

| | | | |
|---|---|---|---|
| 2,917,217 | A | 12/1959 | Sisson |
| 3,333,515 | A | 8/1967 | McGlynn |
| 3,696,987 | A | 10/1972 | Schuff et al. |
| 3,754,699 | A | 8/1973 | Moore |
| 3,759,437 | A | 9/1973 | Amberg |

(Continued)

FOREIGN PATENT DOCUMENTS

| | | |
|---|---|---|
| CL | 34872 | 6/1985 |
| CL | 199601136 | 2/1997 |

(Continued)

OTHER PUBLICATIONS

Office Action from corresponding JP2007507504, Oct. 18, 2011.
Office Action for counterpart application CL2782013, mailed Mar. 10, 2014.

*Primary Examiner* — Ellen S Wood
(74) *Attorney, Agent, or Firm* — McGarry Bair PC

(57) ABSTRACT

A commercially viable paper wrapped foam cup comprising a taper portion that prevents the shrinkage-induced curling from interfering with the un-nesting of nested paper wrapped foam cups. The paper wrapped cup further comprises a fillet for strengthening the cup foot to retard shrinkage-induced curling of the foot. The paper wrapper has abutting to overlapping opposing ends to completely hide the foam cup to enhance the visual appearance of the cup. The overlapping portions of the paper wrapper are not bonded to each other to prevent wrinkling of the paper wrapper as the cup shrinks. A machine and corresponding method provide for automatically supplying foam cups and paper wrappers, wrapping the paper wrapped cup, and stacking the wrapped cups.

19 Claims, 7 Drawing Sheets

(56) References Cited

U.S. PATENT DOCUMENTS

| | | | | | |
|---|---|---|---|---|---|
| 3,988,521 | A | | 10/1976 | Fumel et al. | |
| 4,007,670 | A | | 2/1977 | Albano et al. | |
| 4,016,327 | A | | 4/1977 | Fumei et al. | |
| 4,130,234 | A | | 12/1978 | Schmidt | |
| 4,197,948 | A | * | 4/1980 | Amberg et al. | 206/520 |
| 4,273,816 | A | * | 6/1981 | Tollette | 428/34.2 |
| 4,288,026 | A | | 9/1981 | Wilhelm | |
| 4,332,635 | A | | 6/1982 | Holbrook et al. | |
| 4,420,081 | A | * | 12/1983 | Dart | 206/519 |
| 4,832,783 | A | | 5/1989 | Nechay et al. | |
| 4,909,394 | A | * | 3/1990 | Stewart | 206/520 |
| 5,911,904 | A | | 6/1999 | Shih et al. | |
| 6,257,485 | B1 | | 7/2001 | Sadlier et al. | |
| 6,267,837 | B1 | | 7/2001 | Mitchell et al. | |
| 2002/0041046 | A1 | | 4/2002 | Hartjes et al. | |
| 2002/0144769 | A1 | | 10/2002 | DeBraal et al. | |
| 2002/0172784 | A1 | | 11/2002 | DeBraal et al. | |
| 2002/0182347 | A1 | | 12/2002 | DeBraal et al. | |
| 2003/0003251 | A1 | | 1/2003 | DeBraal et al. | |
| 2005/0061821 | A1 | * | 3/2005 | Smith et al. | 220/675 |

FOREIGN PATENT DOCUMENTS

| | | | |
|---|---|---|---|
| DE | 4409952 | C1 | 2/1995 |
| GB | 1391371 | A | 4/1975 |
| JP | 5230301 | U | 3/1977 |
| JP | 52 148384 | A | 12/1977 |
| JP | 5442803 | Y2 | 12/1979 |
| JP | 5829928 | U | 2/1983 |
| JP | 340731 | Y2 | 8/1991 |

* cited by examiner

PAPER WRAPPED FOAM CUP AND METHOD OF ASSEMBLY

CROSS-REFERENCE TO RELATED APPLICATION

This application claims priority from U.S. provisional application 60/521,359, filed Apr. 8, 2004.

FIELD OF THE INVENTION

In one aspect, the invention relates to a paper wrapped foam cup. In another aspect, the invention relates to a method for automatically assembling a paper wrapped foam cup.

DESCRIPTION OF THE RELATED ART

Paper wrapped foam cups, while known in the art, currently comprise a small portion of the beverage cup market compared to foam-only cups, even though the paper wrapped foam cups have similar insulating qualities of the foam-only cups and are much better suited for printing on the exterior of the cup.

Prior paper wrapped foam cups generally comprise a traditionally made foam cup in combination with a paper layer that is wrapped about and bonded to the exterior of the foam cup. The paper can be pre-printed with any desired image or text prior to the wrapping of the paper to the exterior of the foam cup. It is much easier to print on the paper than on the exterior of the foam cup. The quality of printing on the paper is superior to printing on foam.

In addition to superior printing characteristics, for a given total wall thickness, a paper wrapped foam cup has greater hoop strength, resulting in a more rigid cup that better resists radial deflection and greater columnar strength. The greater rigidity and columnar strength reduces the possibility that the cup will radially collapse in response to a consumer squeezing the cup or collapse when lidded.

Many consumers also find the paper wrapped foam cups aesthetically more pleasing both in visual appearance and in feel, to a foam only cup. They also perceive the paper wrapped foam cup to be of a higher quality and have a greater panache. Paper wrapped foam cups can be, under certain circumstances, more cost effective to make than foam-only cups and conventional paper hot and cold cups.

Yet, even with all of these advantages, paper wrapped foam cups comprise only a very small portion of the hot and cold beverage cup market. Therefore, there is still a strong desire and need within the beverage cup market for a commercially viable paper wrapped foam cup.

SUMMARY OF THE INVENTION

In one aspect, the invention relates to a wrapped foam cup comprising an expanded foam cup having a wrapper. The expanded foam cup comprises a bottom wall and a peripheral wall extending away from the bottom wall. The bottom wall has an upper surface and a lower surface. The peripheral wall has an inner surface and an outer surface. Collectively, the upper surface and inner surface define a beverage cavity. The peripheral wall terminates in a top edge that defines an opening to the beverage cavity. The wrapper is wrapped around and bonded to the outer surface of the cup and has opposing ends connected by an upper edge and a lower edge. The upper edge is located near the top edge of the cup. The peripheral wall has a first portion with a first taper and a second portion with a second taper, which is greater than the first taper.

In another aspect, the invention relates to a wrapped foam cup comprising an expanded foam cup having a wrapper. The expanded foam cup comprises a bottom wall and a peripheral wall extending away from the bottom wall. The bottom wall has an upper surface and a lower surface and the peripheral wall has an inner surface and an outer surface. The upper surface and inner surface define a beverage cavity and the peripheral wall terminates in a lip that defines an opening to the beverage cavity. The wrapper is wrapped around and bonded to the outer surface of the cup. The wrapper has opposing ends connected by an upper edge and a lower edge, with the upper edge adjacent the lip of the cup. The peripheral wall has an upper taper portion extending to the lip and the upper taper portion is tapered such that the shrinkage of the expanded foam cup would not cause the lip to interfere with the un-nesting of nested similar wrapped foam cups.

In yet another aspect, the invention relates to a method for automatically assembling a wrapper to an outer surface of a pre-made foam cup to form a wrapped foam cup. The method comprises:

(1) automatically supplying a pre-made expanded foam cup;
(2) automatically supplying a wrapper sized to be wrapped about an exterior of the foam cup;
(3) heating the wrapper to a temperature where the wrapper will bond to the exterior of the foam cup;
(4) automatically wrapping the wrapper about the exterior of the foam cup to effect the bonding of the wrapper to the exterior of the foam cup;
(5) repeating steps 1-4 multiple times to form multiple wrapped cups; and
(6) automatically assembling at least some of the multiple wrapped cups into a group suitable for subsequent handling.

In yet one other aspect, the invention relates to an apparatus for automatically assembling a wrapper to a foam cup to form a wrapped foam cup. The apparatus comprises a rotating platen having multiple carriers, with each carrier sized to support a wrapper. A heater is provided for heating the wrapper to a bonding temperature. A rotating mandrel assembly comprises multiple rotatable mandrels, with each of the mandrels supporting a different cup. The rotating platen and rotating mandrel assembly are arranged relative to each other such that upon their relative indexed rotation a rotatable mandrel is effectively rolled over the surface of a carrier to effect the wrapping of a wrapper on the carrier about a cup on the mandrel.

BRIEF DESCRIPTION OF THE DRAWINGS

FIG. 1 illustrates the stacked cups in a post-wrapped, pre-shrunk state and FIG. 2 illustrates the stacked cups in a shrunken state.

DESCRIPTION OF THE PREFERRED EMBODIMENT

It should be noted that while the below description references specific dimensions for the paper wrapped foam cup, the drawings are not necessarily to scale. To clearly illustrate some of the features of the paper wrapped foam cup some portions of the drawings have been exaggerated.

While working on developing a commercially successful paper wrapped cup, the current inventors encountered a previously unknown problem for paper wrapped cups. A solution to the problem is necessary to make a commercially successful cup. The problem finds its origin in that the foam most commonly used for paper wrapped foam cups is expanded polystyrene foam. After a possible post-molding expansion, such foam is known to shrink over time after the completion of the molding process. With prior foam-only cups, the shrinkage never posed a problem as the foam-only cup was unrestrained in all dimension and could therefore simultaneously shrink in all dimensions. In other words, all portions of the foam-only cups shrunk substantially to the same extent, thus keeping the cup proportions generally constant.

Figure 1:
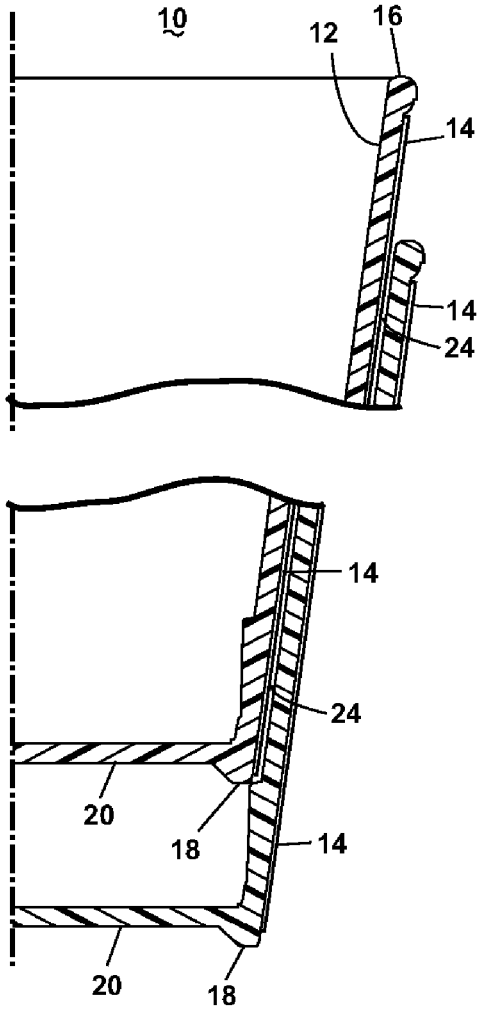
FIGS. 1 and 2 are enlarged sectional views of a pair of stacked paper wrapped foam cups illustrating a shrinkage-induced stacking problem overcome by the invention.
Figure 2:
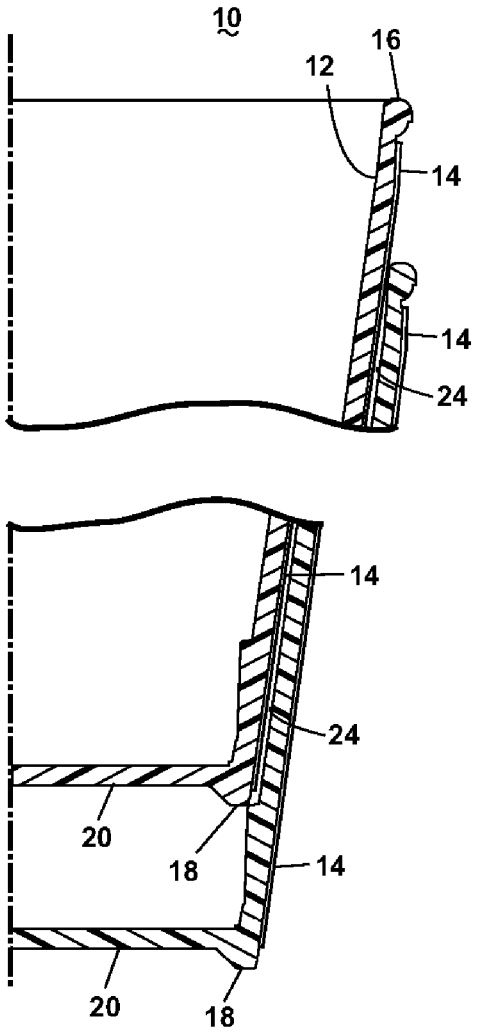
Figure 3:
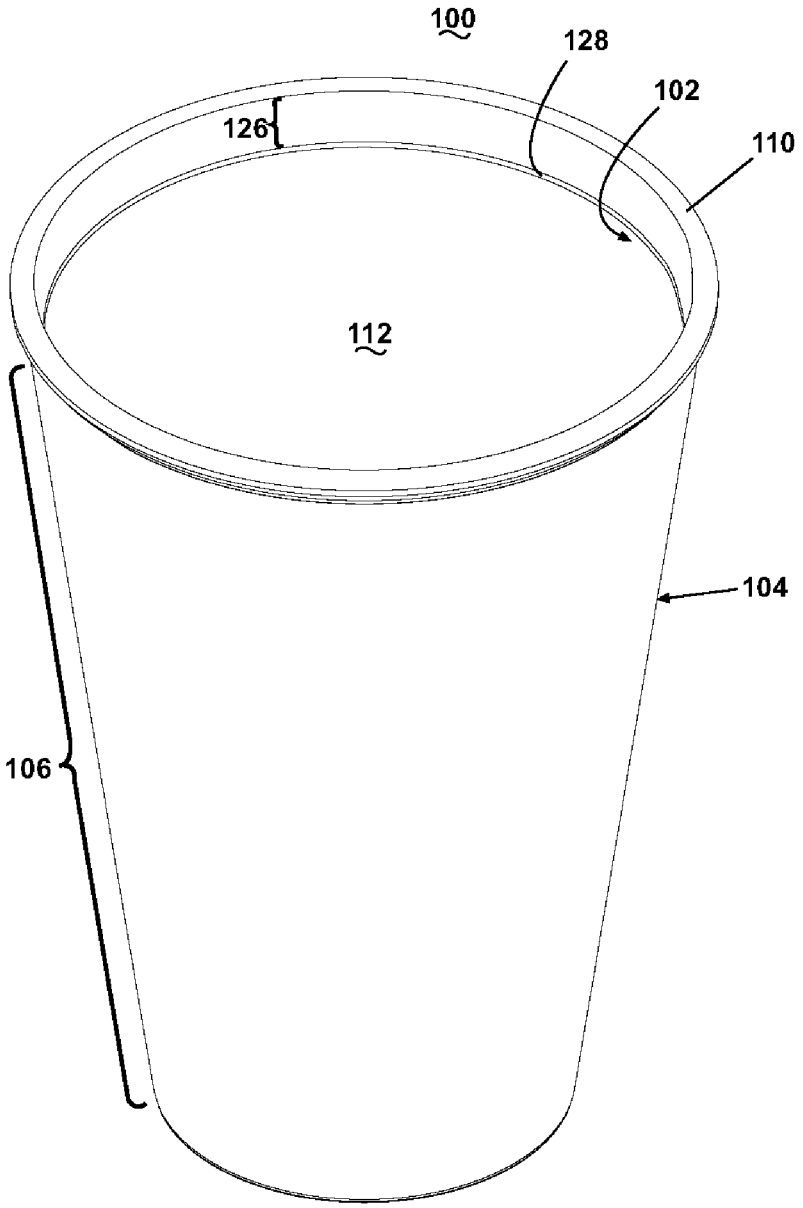
FIG. 3 is a perspective view of a paper wrapped foam cup according to the invention that overcomes the shrinkage-induced stacking problem associated with the paper wrapped foam cups.
Figure 4:
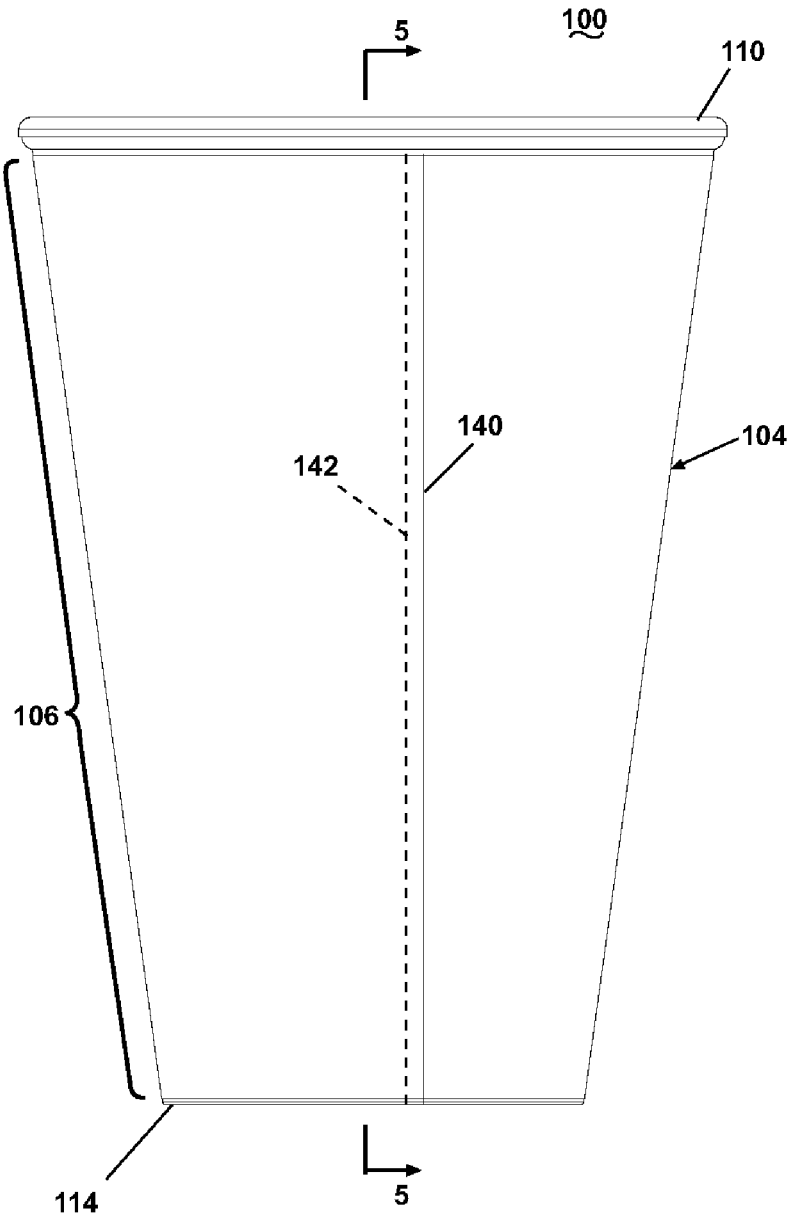
FIG. 4 is a side view of the paper wrapped foam cup of FIG. 3.
Figure 5:
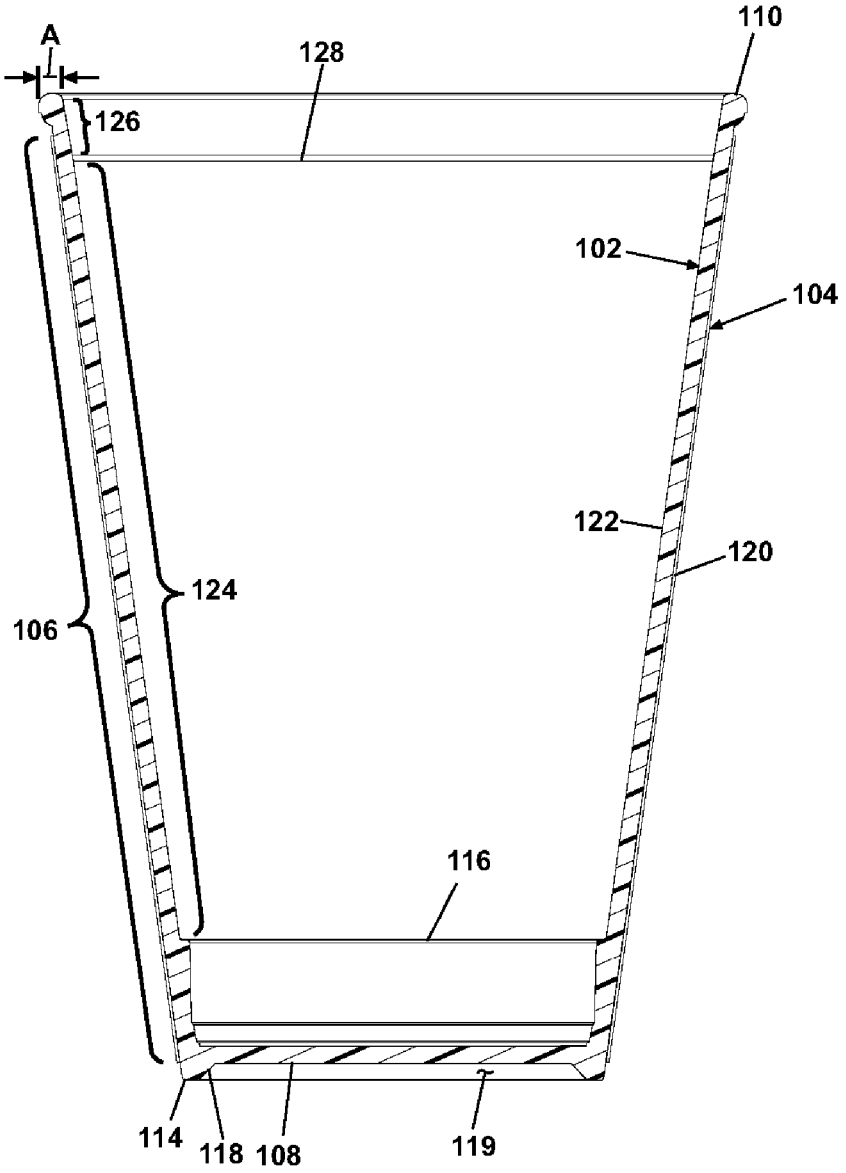
FIG. 5 is a sectional view taken along line 5-5 of FIG. 4.
Figure 6:
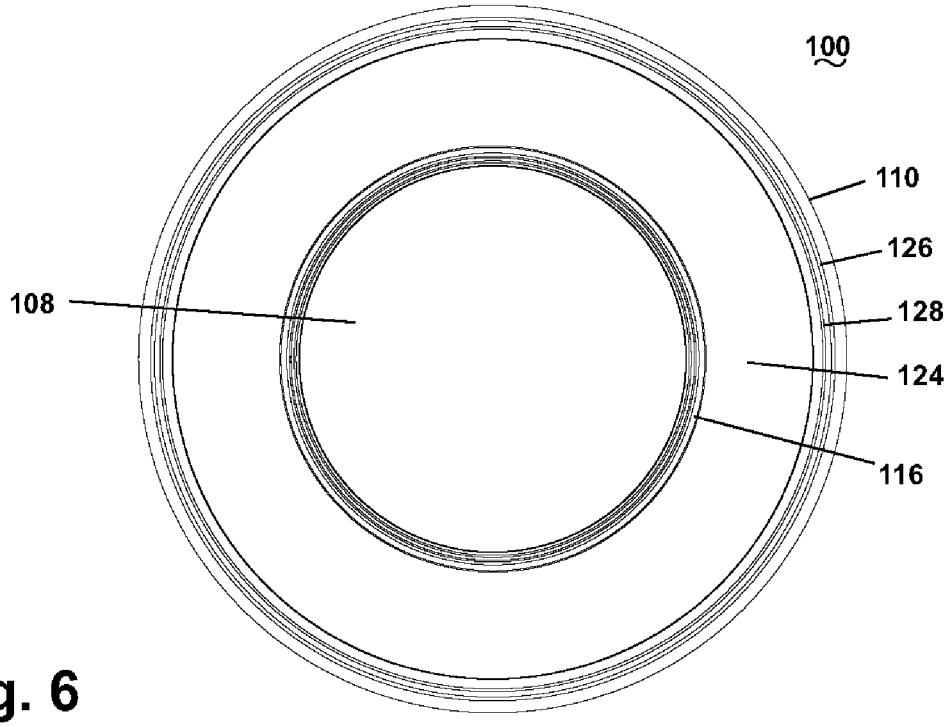
FIG. 6 is a top view of the paper wrapped foam cup of FIG. 4.
Figure 7:
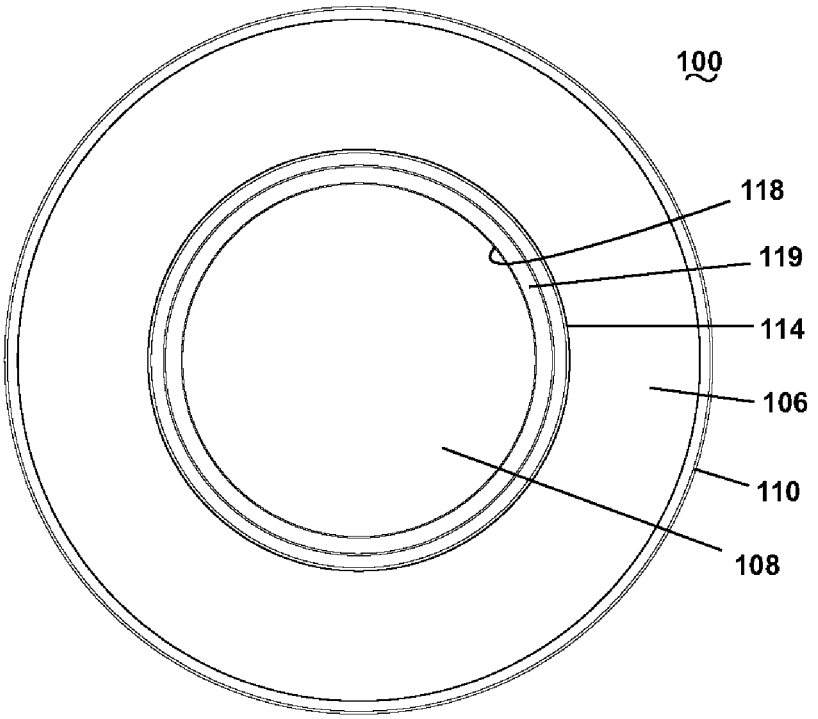
FIG. 7 is a bottom view of the paper wrapped foam cup of FIG. 4.

Such is not the case with the paper wrapped foam cups. FIGS. 1 and 2 illustrate a paper wrapped foam cup 10 comprising a foam cup 12 and a paper wrapping 14 that extends from just beneath a lip 16 to almost the tip of a foot 18 extending away from a bottom 20 of the cup. It has been found that the addition of the paper wrapping 14 bonded to the foam constrains the shrinking of the foam in contact with the paper wrapping 14. The portions of the foam not in contact with the paper tend to shrink as they would otherwise. Since the foam shrinks in all three dimensions except for where it is in contact with the paper, the lip 16 tends to curl inwardly from its pre-shrunk position (FIG. 1) to project radially inwardly in its shrunken state (FIG. 2).

The curling of the lip 16 is very detrimental to the separation of the nested cups. It is common to design cups such that they can stack or nest within each other while leaving an air gap 24 between the stacked cups. The air gap 24 aids in the subsequent separation of the cups by preventing the frictional interaction between the walls of the nested cups and preventing a low pressure area from forming between the bottoms 20 of the nested cups upon the withdrawal of one of the cups. The air gap 24 is normally designed such that upon the inverting of the cups, the nested cup will fall out of the outer cup. A typical air gap is about 0.015 inches. With this structure, nested cups can easily be separated which is very important, especially in high volume environments, such as fast food restaurants, or in automated beverage dispensing systems, which can jam when the cups do not properly separate.

The curling of the lip 16 can be great enough to result in the lip projecting radially inwardly a distance greater than the air gap 24, causing a nesting cup to contact the curled lip 16, creating frictional resistance between the curled lip 16 and the nesting cup paper wrapping 104. If the force used to nest the cup 10 is great enough to deflect either or both the curled lip 16 and the sidewall of the outer cup, the inherent resiliency of the foam applies a compressive force from the curled lip against the sidewall of the outer cup. Either of the frictional resistance or the compressive force is great enough to hold the cups in the nested condition when inverted.

The curling also can negatively impact the stacking height of the nested cups, which ultimately increases the shipping costs of the cups. The curling can prevent a nesting cup from being completely inserted into another cup. Such a condition increases the stack height of a given number of cups. The increased stack height means that a greater volume or "cube" is required for a given number of cups, which reduces the total number of cups that can be shipped in a fixed volume container, resulting in increased shipping costs. The shipping cost of beverage cups is a significant portion of the overall cost of the cup. It is highly desirable to minimize the shipping costs. Therefore, it is highly desirable to stack the cups in a manner such that as many cups as possible can be fit within a given cube.

The paper wrapped foam cup 100 illustrated in FIGS. 3-9 addresses the problems associated with the shrinkage-induced curling of the lip for a paper-wrapped cup. The paper wrapped foam cup 100 comprises a foam cup 102 that is wrapped by a paper wrapper 104. The foam cup 102 comprises a peripheral sidewall 106 that extends from a bottom wall 108 and terminates in a radially projecting lip 110. The bottom wall 108, sidewall 106 and lip 110 define an open-top beverage cavity 112 that is accessible through the open top defined by the lip 110.

A foot 114 extends downwardly from the bottom wall 108. The foot 114 can be thought of as an extension of the sidewall 106. A shoulder 116 extends radially into the beverage cavity 112 from the sidewall 106. The shoulder 116 cooperates with the foot 114 of a nesting cup to limit the extent of the insertion of the nesting cup.

A fillet 118 extends between the foot 114 and the bottom wall 108. As illustrated, the fillet 118 is integrally formed with the foot 114 and the bottom wall 108 and extends continuously along the foot 114 and bottom wall 108 to form an annular shape. The fillet 118 defines an annular surface 119, which is shown having a 45 degree angle relative to the vertical. Other angles are within the scope of the invention.

The sidewall 106 has an outer surface 120 with a constant taper preferably extending from the foot 114 to the lip 110. As illustrated, the constant taper of the outer surface 120 defines a 7.79 degree acute angle relative to the vertical. In contrast, the sidewall 106 has an inner surface 122 with a constant taper portion 124 and a variable taper portion 126. As illustrated, the constant taper portion 124 defines the same angle, relative to the vertical, as the outer surface 120 (although the constant taper portion could define a different angle) and extending from the shoulder 116 to the variable taper portion 126, resulting in the sidewall 106 having a constant thickness along the extent of the constant taper portion 124.

The variable taper portion 126 extends from below the lip 110 up to, and preferably, although not necessarily, including the lip 110. As illustrated the variable taper portion 126 generally forms an acute angle of 9.64 degrees relative to the vertical. For manufacturing purposes, the transition from the constant taper portion 124 to the variable taper portion 126 is effected by a radius 128, instead of a line, which as illustrated has an arc defined by an angle of 1.84 degrees.

For purposes of this disclosure, the radius is treated as part of the variable taper portion 124.

Since the angle of the variable taper portion 126 is greater than the angle of the corresponding portion of the outer surface 120, there is a constant reduction in thickness of the sidewall 106 along the extent of the variable taper portion up to the lip 110. Preferably, the variable taper portion 126 extends along the lip 110 up to the top edge of the cup 100.

Figure 8:
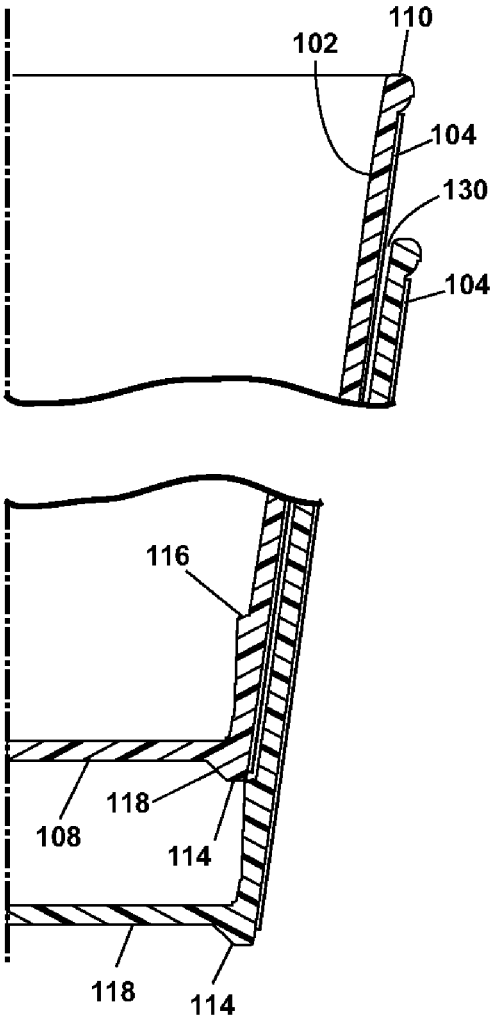
FIG. 8 is an enlarged view of a pair of stacked paper wrapped foam cups of FIG. 4 in the post-wrapped, pre-shrunk state.
Figure 9:
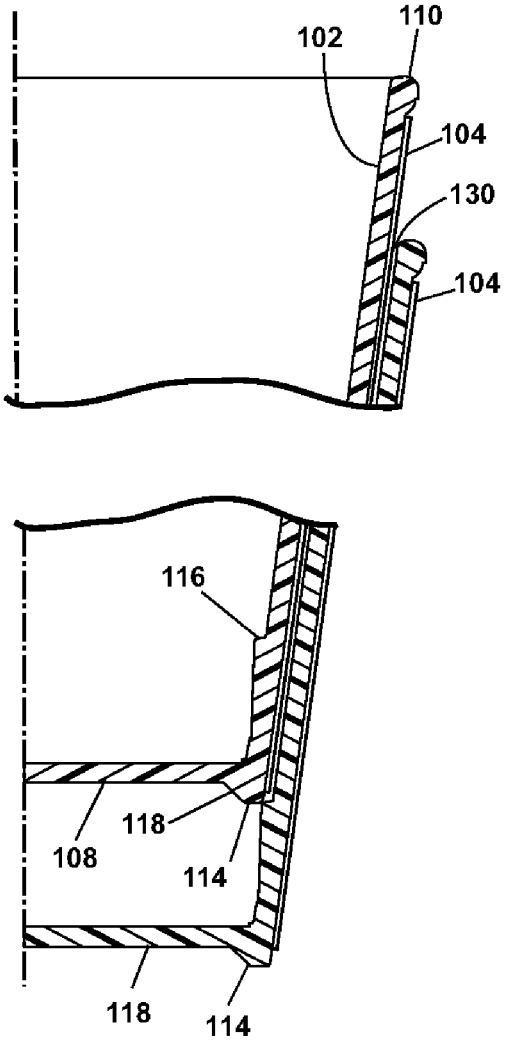
FIG. 9 is an enlarged view of a pair of stacked paper wrapped foam cups of FIG. 4 in the shrunken state.

The benefit of the variable taper portion 126 is that it increases the air gap between stacked cups along the variable taper portion as compared to the air gap along the constant taper portion 124. This is best seen in FIG. 8, which illustrates two freshly wrapped stacked cups 100, which define an air gap 130. The air gap 130 along the variable taper portion 126 increases relative to the air gap 130 along the constant taper portion 124. Along the constant taper portion 124, the air gap 130 is approximately 0.015 inches. At the top edge of the cup along the variable taper portion, the air gap is approximately 0.25 inches. Referring to FIG. 9, as the cups 100 shrink over time, the lips 110 curl as previously described. The curling reduces the air gap 130 at portions of the variable taper portion 124. However, the reduction of the air gap 130 related to the curling is not great enough to close the air gap 130, thereby preventing the curling lip 130 from contacting the nested cup and interfering with the separation of the stacked cups and/or the stacking of the cups.

While the variable taper portion 126 is illustrated as a single planar surface or facet having a constant acute angle relative to the vertical (ignoring the radius 128), it is within the scope of the invention for the variable taper portion to comprise multiple facets. Each of the facets can form a different angle relative to the vertical. The variable taper portion 126 can also be formed by a continuous radius or multiple radii. Additionally, the variable taper portion 126 can be formed by a combination of facets and radii.

Whichever structure is used to create the variable taper portion 126, it is important that the resulting variable taper portion 126 create a sufficient air gap 130 along the variable taper portion such that any shrinkage-induced curling of the lip 110 does not close off the air gap 130 to a point sufficient to hinder separation. This will ensure that the shrinkage does not interfere with the separation and stacking of the cups 100.

While not a limitation on the invention, it is preferred that the variable taper portion 126 be selected such that the width (Dimension A, FIG. 5) of the lip along the upper edge be the same dimension as that found on similar sized foam-only cups as this will permit current lids for the foam-only cups to be used on the paper-wrapped foam cups 100.

The foot 114 of the cup 100 is potentially subject to the same shrinkage-induced curling as the lip 110. If the foot 114 were to curl a sufficient amount that the foot 114 did not rest on the shoulder 116 of another cup when stacked, it would have a devastating impact on the stacking and separation of the cups. However, the additional strength and material mass provided by the fillet 118 sufficiently controls any curling of the foot 114. The fillet 118 is further beneficial in that it provides additional structure support for the foot 114 against pressure applied to the foot 114 during the wrapping process. Unlike the sidewalls of the cup which are internally supported by a mandrel during wrapping, the interior of the foot 114 is unsupported. The ability to apply pressure to the foot 114 without fear of the foot 114 collapsing enhances the adhesion of the paper wrapper 104 to the foot 114, which reduces the likelihood that the paper will buckle or wrinkle at the foot 114.

For reference purposes, it should be noted that the dimensions for the cup relate to a 16 oz cup made from expanded polystyrene foam having a density of approximately 3.28 $lb/ft^3$ and a sidewall thickness along the constant taper portion 124 of approximately 0.082 inches. These cup parameters can vary with cup size. For example, the sidewall thickness often varies with the volume of the cup. The greater the volume, the greater the wall thickness to help structurally support the additional beverage volume. All else being equal, the sidewall thickness of a paper wrapped foam cup is less than a foam-only cup because of the extra strength provided by the paper.

While the structure of the foam cup related to controlling the shrinkage-induced curling greatly contribute to creating a commercially successful paper-wrapped foam cup, the paper wrapper 104 has features that also contribute to a commercially successful paper-wrapped cup. Preferably, the paper wrapper 104 extends substantially from the lip 110 to the bottom of the foot 114. For ease of assembly, the paper wrapper 104 preferably stops approximately 0.030 inches from the lip 110 and 0.030 inches from the bottom of the foot 114. Even with the 0.030 inch gap between the paper and the lip 100 and foot 114, when a lid is placed on the cup 100, the cup 100 has the appearance of a paper-only cup since almost all of the foam is hidden from the consumer.

The paper wrapper 104 completely circumscribes the cup 110 and has opposing ends 140 and 142 (FIG. 4), with one of the ends (illustrated as end 140) butting to overlapping the other end. The overlap is beneficial in that it ensures that no portion of the foam cup 102 is visible, which is aesthetically superior for most consumers, who perceive it as a higher quality cup. It is preferred that the overlap does not exceed 0.040 inches. Overlaps of less than this amount have shown the least tendency to wrinkle.

For a preferred paper, such as 40 lb Capri Gloss made by Stora Enso, which has a thickness of approximately 2 mils, the overlap preferably ranges from abutting to less than approximately 40 mils. The combination of paper thickness and the extent of overlap results in the consumer not being able to feel the overlapped portion, which also enhances the aesthetics of the cup 100, adding to the commercial success of the cup 100.

It is preferred that the overlapping portion of the paper wrapper 104 is not bonded to the underlying portion of the paper wrapper 104 to prevent the formation of any wrinkles in the paper wrapper 104 along the overlapping portion in response to the shrinkage of the cup 102. It is also preferred that the overlap is less than 0.040 inches to reduce the possibility of wrinkling.

The paper can be any suitable type of paper. For example, it can be coated or uncoated. It can be fiber-based or polymer-based. It can be a single layer or multiple layers. The paper can have suitable bonding materials incorporated into the coating as does the Capri Gloss made by Stora Enso. Alternatively, a specially selected bonding material, such as an adhesive, can be added to the paper as part of wrapping of the paper to the cup. The specific adhesive is not germane to the invention.

Figure 10:
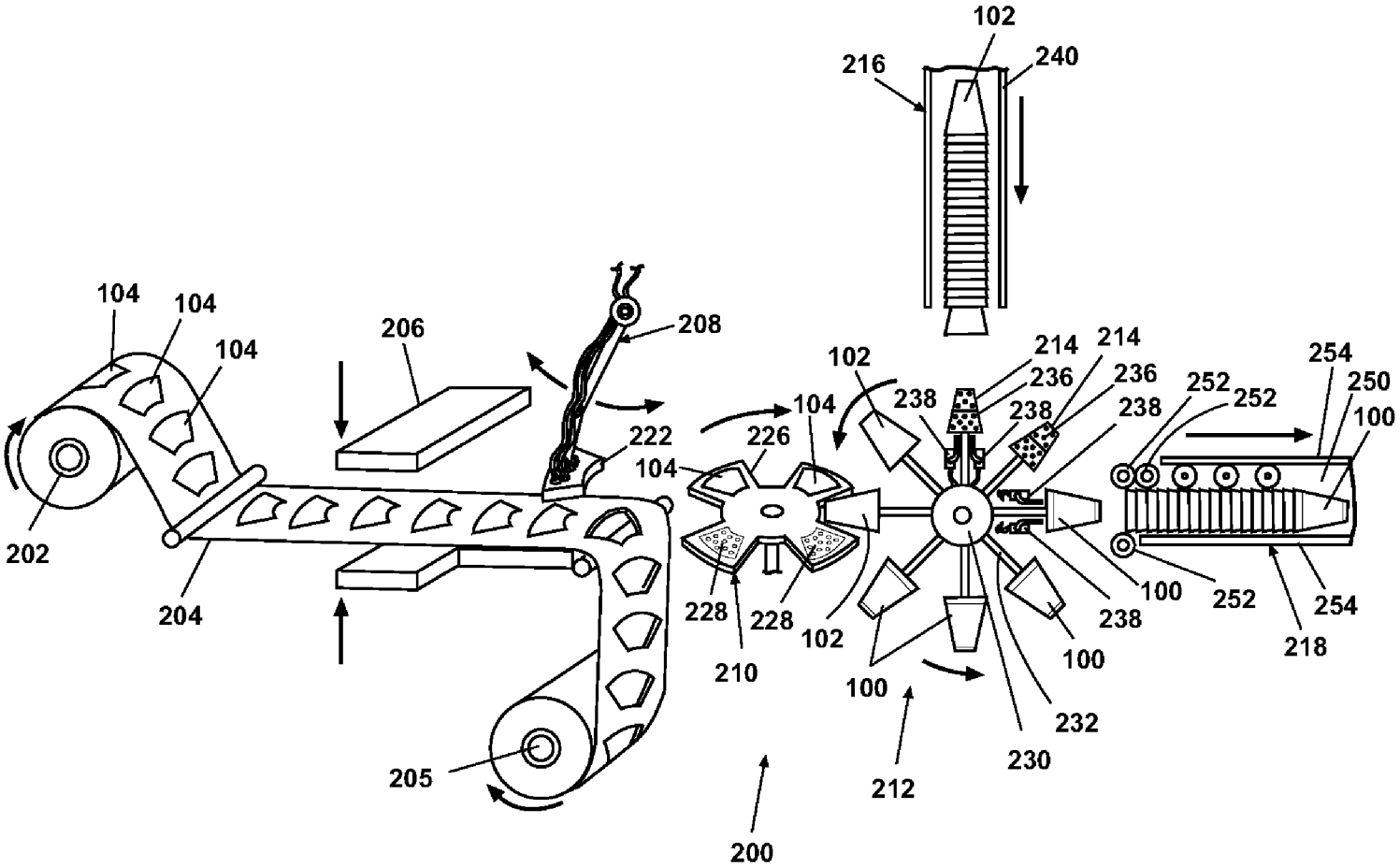
FIG. 10 is a schematic of an assembly machine suitable for assembling any paper wrapped foam cup, especially the paper wrapped foam cup of FIG. 4.

FIG. 10 illustrates a schematic of an assembly machine 200 suitable for assembling the paper wrapped cup 100. In general, the assembly machine 200 comprises a paper roll 202 comprising a web of paper 204 on which are printed multiple paper wrappers 104. The web 204 is fed through a punch assembly 206 that punches the paper wrappers 104 from the web 204, with the skeleton of the punched web being fed to a take up roll 205. The punched paper wrappers 104 are then picked up by a reciprocating arm 208 and placed on a rotation platen 210, which carries the paper wrappers 104 to a rotating mandrel assembly 212 where the paper wrappers 104 are wrapped about a foam cup. The mandrel assembly 212 is fed pre-made foam cups from an escapement 216. A cup out-feeder 218 receives and stacks the wrapped cups 100.

Looking at the assembly machine in greater detail, the punch assembly 206 is preferably a traditional punch and die. The reciprocating arm 208 comprises a pick up 222, which is conveniently shaped to correspond to the shape of the paper wrapper 104. The pick up 222 also comprises several air passages through which pressurized air or a vacuum can be applied to the paper wrapper 104 to aid in the picking up and releasing of a paper wrapper 104.

The rotating platen 210 comprises multiple spaced carriers 226, each one sized to support a paper wrapper 104. The spacing between the carriers 226 is great enough to permit the passage of the mandrel assembly 212. Preferably, each of the spaced carriers has a series of air passages 228 such that either a vacuum or pressurized air can be applied to the paper wrapper 104 to aid in holding the paper wrapper 104 to the carrier 226 or removing the paper wrapper 104 from the carrier.

The mandrel assembly 212 comprises a rotating hub 230 from which extend multiple spokes 232. A mandrel 214 is rotatably mounted to each of the spokes such that the mandrel 214 can rotate about the longitudinal axis of the corresponding spoke 232. Each mandrel 214 comprises multiple air passages 236 through which either pressurized air or a vacuum can be applied to a foam cup 102 carried by the mandrel to aid in the holding or releasing of the cup to and from the mandrel 214. External pressurized air nozzles 238 aid in the removal of the wrapped cups 100 by providing a blast of pressurized air to blow the cup 100 off of the mandrel 214.

The escapement 216 is well known in the industry and comprises a chute 240 in which is received a stack of foam cups 102. Any one of several well known cup feed mechanism can be used to release one cup 102 at a time onto a mandrel 214 positioned beneath the chute 240. Known cup feed mechanisms include rotating screws and cams. The type of feed mechanism is not germane to the invention.

The out-feeder 218 comprises a cup receiving chute 250 partially defined by a series of rollers 252 and guide plates 254. The rollers 252 are preferably brush rollers, with at least the first upper and lower rollers being drive rollers. The drive rollers can be rotated to propel a cup received between the drive rollers further into the chute.

While not shown, a controller is provided to synchronize the movement of the various elements of the assembly machine 200, including the actuation of the various air pressure and vacuum supplies. A suitable controller would be a programmable logic controller.

In operation, the web 204 is advanced from the paper roll 202 through the punch assembly 206 and onto the take up roll 205. As the web 204 passes through the punch assembly 206, the individual paper wrappers 104 are punched from the web 204.

The pick up 222 of the reciprocating arm 208 is lowered onto the punched paper wrapper 104 and the vacuum is applied to the pick up 222 to hold the paper wrapper 104 to the pick up 222. The reciprocating arm 208 then moves such that the pick up 222 is positioned above a carrier 226. The reciprocating arm 208 is then lowered to bring the pick up 222 into contact with the carrier 226. The vacuum to the pick up 222 is stopped and vacuum is then applied to the carrier 226 to transfer the paper wrapper 104 to the carrier 226.

The paper wrapper 104 is then heated while it is on the carrier 226. The heating can be accomplished by providing an external heater that radiates heat onto the paper wrapper 104. Preferably, the carriers 226 are directly heated, such as by a resistive heating element. Thus, the paper wrapper 104 is heated as the carrier 226 is rotatably indexed to the mandrel assembly 212.

Preferably, the temperature of the carrier plate is between 375° and 400° F. and the paper wrapper 104 sits on the carrier 226 for between 8 to 15 seconds. Testing has shown that this temperature and time combination is sufficient to heat the paper wrapper 104 such that the bonding materials in the preferred paper are suitable for bonding to the foam cup 102. For the previously described preferred paper, the preferred temperature is 400° F. and the time to wrap the paper wrapper is 1-3 seconds. In some tests, plate temperatures of 440° were needed to obtain the desired degree of adhesion.

As the platen 210 is rotated, the carrier 226 is ultimately brought into position with one of the mandrels 214 on which a cup 102 is being carried. The platen 210 and mandrel assembly 212 are indexed such that the cup-carrying mandrel 214 is brought into contact with the leading edge of the carrier 226. With the cup-carrying mandrel 214 remaining in this position, the platen 210 continues to rotate beneath the mandrel 214. Since the mandrel 214 is free to rotate relative to the spoke 232, the rotation of the platen 210 effectively rolls the mandrel 214 and the cup 102 it is carrying along the paper wrapper 104. In this manner the paper wrapper 104 is wrapped about the cup 102. Once the carrier 226 passes from beneath the mandrel 214, the mandrel 214 is positioned above the space between the carriers 226. The mandrel assembly 212 then rotates the next mandrel into position to wrap another cup.

As the cup wrapping process continues, the wrapped cup 100 is eventually rotated into alignment with the chute 250 of the out-feeder 218. At this time the vacuum to the mandrel 214 is replaced by pressurized air and the external air nozzles 238 hit the cup 100 with a blast of pressurized air. The pressurized air from the mandrel and the air nozzles 238 force the cup 100 off of the mandrel 214 and into the chute 250. The drive rollers 252 are continuously activated to propel the expelled cup 100 further down the chute 250 and stack the cup 100 within any waiting cups.

As the cup wrapping process continues, the previously emptied mandrel is rotated beneath the escapement 216. In this position, a vacuum is applied to the mandrel and the lowermost cup 102 of the stack is moved onto the mandrel 214 by the escapement 216.

The process is repeated until the paper wrapping is completed.

While not shown, the out-feeder 218 can be coupled to a traditional packaging assembly line. In such situation, the cups 100 would be ejected from the chute 250 when a predetermined number were stacked therein. The ejected stack of cups 100 would then be automatically bagged and put into a suitable container for shipping. Preferably, the out-feeder 218 would stack the cups within a protective sleeve prior to ejection.

Similarly, the escapement 216 can be directly fed cups 102 from a traditional cup manufacturing line. The benefit of this configuration is that it is not necessary to inventory the cups prior to wrapping, which reduces space and capital requirements. In fact, the invention is ideally suited for immediately wrapping freshly made foam cups. Freshly made cups are subject to more curling than cups that have aged prior to wrapping. This is because the cups immediately begin shrinking, subject to some temporary post-molding expansion, after they are made. Cups that are permitted to age prior to wrapping will have less curling since the cup is permitted to shrink in all dimensions. While the wrapping of sufficiently aged cups is one way to minimize curling, given the large production volumes used in contemporary cup molding facilities, it is not cost effective to provided the needed capital and storage for the aged cups.

What is claimed is:

1. A wrapped foam cup comprising:

an expanded foam cup comprising a bottom wall and a peripheral wall extending away from the bottom wall, the bottom wall having an upper surface and a lower surface, the peripheral wall having an inner surface and an outer surface, the upper surface and the inner surface defining a beverage cavity, and the peripheral wall terminating in a lip that defines an opening to the beverage cavity;

a wrapper wrapped around and bonded to the outer surface of the cup, the wrapper having opposing ends connected by an upper edge and a lower edge, with the upper edge of the wrapper near the lip of the cup;

a shoulder located along the inner surface of the peripheral wall for supporting a similar wrapped foam cup in a nested relationship with the wrapped foam cup;

wherein the peripheral wall has a first portion, above the shoulder, with a first outward taper and a second portion, above the first portion, with a second outward taper, the second portion extending at least up to the lip of the cup, and the upper edge of the wrapper lies on the second portion of the peripheral wall; and wherein the second outward taper is greater than the first outward taper.

2. The wrapped foam cup according to claim 1, wherein the second portion has a thickness less than the first portion.

3. The wrapped foam cup according to claim 2, wherein the second portion has a continuously reducing thickness in a direction toward the upper edge of the peripheral wall.

4. The wrapped foam cup according to claim 1, wherein the second outward taper is variable.

5. The wrapped foam cup according to claim 4, wherein the first outward taper is constant.

6. The wrapped form cup according to claim 5, wherein the first outward taper extends along the entire length of the first portion of the peripheral wall.

7. A pair of wrapped foam cups, each cup comprising:

a bottom wall and a peripheral wall extending away from the bottom wall, the bottom wall having an upper surface and a lower surface, the peripheral wall having an inner surface and an outer surface, the upper surface and the inner surface defining a beverage cavity, and the peripheral wall terminating in a lip that defines an opening to the beverage cavity;

a wrapper wrapped around and bonded to the outer surface of the cup, the wrapper having opposing ends connected by an upper edge and a lower edge, with the upper edge of the wrapper near the lip of the cup;

a shoulder located along the inner surface of the peripheral wall for supporting one of the pair of wrapped foam cups in a nested relationship with the other of the pair of wrapped foam cup;

wherein the peripheral wall has a first portion, above the shoulder, with a first outward taper and a second portion, above the first portion, with a second outward taper, the second portion extending at least up to the lip of the cup, and the upper edge of the wrapper lies on the second portion of the peripheral wall; and wherein the second outward taper is greater than the first outward taper.

8. The wrapped foam cup of claim 7, wherein the shoulder is located along the inner surface of the peripheral wall such that an air gap is formed between the peripheral walls of a pair of nested wrapped foam cups.

9. The wrapped foam cup according to claim 8, wherein the second outward taper is such that the lip of the foam cup does not extend into the cavity beyond the air gap upon the shrinkage of the wrapped foam cup.

10. The wrapped foam cup according to claim 1, wherein portions of the opposing ends are in an overlapping relationship.

11. The wrapped foam cup according to claim 10, wherein the portions of the opposing ends are not bonded together.

12. The wrapped foam cup according to claim 1, wherein the cup further comprises a foot extending downwardly from the bottom wall and the lower edge of the wrapper overlies a portion of the foot.

13. The wrapped foam cup according to claim 12, wherein the cup further comprises a fillet extending between the foot and the lower surface of the bottom wall.

14. The wrapped foam cup according to claim 1, wherein the wrapper is made from paper.

15. The wrapped foam cup according to claim 14, wherein the paper is coated and the coating contains suitable bonding materials for adhering the paper to the foam cup.

16. The wrapped foam cup according to claim 1, wherein the lip is part of a top edge of the cup for mounting a lid.

17. The wrapped foam cup according to claim 16, wherein the upper edge of the wrapper abuts the lip.

18. The wrapped foam cup of claim 16 wherein the upper edge of the paper wrapper lies 0.030 inches or less from the lip.

19. The wrapped foam cup of claim 7 wherein the second outward taper is greater relative to vertical than the first outward taper by an amount such that any curling attributable to the shrinkage of the portion of the foam cup, above the upper edge of the wrapper, is not greater than an air gap formed between second portions of a pair of nested wrapped foam cups.

* * * * *